US007733290B2

(12) United States Patent
Schneider et al.

(10) Patent No.: US 7,733,290 B2
(45) Date of Patent: Jun. 8, 2010

(54) MERCHANDISE SURVEILLANCE SYSTEM ANTENNA AND METHOD

(75) Inventors: Jack Howard Schneider, Coral Springs, FL (US); Brent Franklin Balch, Oakland Park, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 803 days.

(21) Appl. No.: 11/507,920

(22) Filed: Aug. 22, 2006

(65) Prior Publication Data

US 2008/0068273 A1 Mar. 20, 2008

Related U.S. Application Data

(60) Provisional application No. 60/751,737, filed on Dec. 19, 2005.

(51) Int. Cl.
*H01Q 21/00* (2006.01)
*H01Q 7/00* (2006.01)

(52) U.S. Cl. ..... 343/867; 343/866; 343/842

(58) Field of Classification Search ..... None
See application file for complete search history.

(56) References Cited

U.S. PATENT DOCUMENTS 4,135,183 A 1/1979 Heltemes
5,142,292 A * 8/1992 Chang ..... 343/742
6,081,238 A * 6/2000 Alicot ..... 343/742
6,255,998 B1 * 7/2001 Podger ..... 343/867
6,469,674 B1 * 10/2002 Podger ..... 343/742
7,227,504 B2 * 6/2007 Deguchi et al. ..... 343/742
2005/0046572 A1 3/2005 Hader
2005/0162275 A1 * 7/2005 Maitin et al. ..... 340/572.3
2007/0109210 A1 * 5/2007 Bacquet et al. ..... 343/742
2008/0018474 A1 * 1/2008 Bergman et al. ..... 340/572.7

FOREIGN PATENT DOCUMENTS

EP 0257688 A1 3/1988
WO 2004015642 A1 2/2004

* cited by examiner

*Primary Examiner*—Trinh V Dinh
(74) *Attorney, Agent, or Firm*—Christopher & Weisberg, P.A.

(57) ABSTRACT

Embodiments of the invention provide a method, system and apparatus for detecting a merchandise marker in which a first antenna has a circuit having a first loop defining a first area and a second loop defining a second area substantially coplanar with the first area. A second antenna is substantially coplanar and orthogonally positioned with respect to the first antenna. The second antenna has a circuit having a third loop defining a third area and a fourth loop defining a fourth area substantially coplanar with the third area.

20 Claims, 12 Drawing Sheets

MERCHANDISE SURVEILLANCE SYSTEM ANTENNA AND METHOD

CROSS-REFERENCE TO RELATED APPLICATIONS

This application is related to and claims priority to U.S. Provisional Patent Application Ser. No. 60/751,737, filed Dec. 19, 2005, entitled DOOR-MOUNTED EAS ANTENNA, EMPLOYING A PLURALITY OF PHASE-CANCELING MAGNETIC TRANSCEIVER ANTENNAS.

STATEMENT REGARDING FEDERALLY SPONSORED RESEARCH OR DEVELOPMENT n/a

BACKGROUND OF THE INVENTION

1. Statement of the Technical Field

The present invention relates to merchandise surveillance systems and more particularly to antennas for detecting merchandise markers.

2. Description of the Related Art

In a surveillance system, antennas, such as magnetoacoustic EAS (Electronic Article Surveillance) antennas or RF (Radio Frequency) antennas, transmit interrogation signals that are received by markers by RF markers in the case of Radio Frequency ID (RFID) or magnetoacoustic markers in the case of EAS, located on merchandise within an establishment. The markers send corresponding signals back to the antenna. Thus, the interaction between the antennas and the markers establish an interrogation zone that can provide an establishment, such as a retail store, with a security system for its merchandise.

Conventional EAS surveillance systems, such as those that operate at 58 kHZ, include EAS antennas located in a pedestal, the floor, the ceiling or wall or a combination of each such that the EAS antennas can be used to monitor a large volume with the minimum number of antennas. While these types of systems are fine for large department stores and supermarkets, small shop retailers have different concerns since their security budgets may be lower and floor space may be at a great premium. Furthermore, because small retailer establishments are typically smaller than those of major retailers, the small retailer in-store items may need to be situated very close to the detection system, thereby increasing the probability of a false alarm. If large pedestals are used, the space available for items may have to be reduced.

Thus, a need has arisen to overcome the problems with the prior art and more particularly for a smaller and more efficient detector of markers for merchandise surveillance systems.

SUMMARY OF THE INVENTION

Embodiments of the invention address deficiencies of the art in respect to detection of merchandise surveillance markers and provide a novel and non-obvious method, system and apparatus for detecting a merchandise surveillance marker.

In accordance with one aspect, the present invention provides a transceiver for detecting a merchandise marker in which a first antenna includes a first circuit having a first loop defining a first area and a second loop defining a second area substantially coplanar with the first area. A second antenna is substantially coplanar and orthogonally positioned with respect to the first antenna. The second antenna includes a second circuit having a third loop defining a third area and a fourth loop defining a fourth area substantially coplanar with the third area.

In accordance with another aspect, the present invention provides a method for detecting a magneto-acoustic marker in which a first magnetic field is produced by sending a current in a first direction through a first transceiver antenna. The first transceiver antenna has a first loop defining a first area and a second loop defining a second area substantially coplanar with the first area. A second magnetic field is produced by sending a current in a second direction through a second transceiver antenna having a third loop defining a third area and a fourth loop defining a fourth area substantially coplanar with the third area. The second transceiver antenna is substantially coplanar and orthogonally positioned with respect to the first transceiver antenna. A magneto-acoustic marker is detected by receiving a signal from the first or the second antenna.

In another embodiment of the present invention, a method for detecting a magneto-acoustic marker is disclosed. The method can include producing a first magnetic field by sending a current in a first direction through a first transceiver antenna comprising a circuit having a first loop defining a first area and a second loop defining a second area coplanar with the first area, wherein current flows in the first loop in a first direction and current flows in the second loop in a second direction. The method may further include producing a second magnetic field by sending a current in a second direction through a second transceiver antenna comprising a circuit having a first loop defining a third area and a second loop defining a fourth area coplanar with the third area, wherein current flows in the first loop in a first direction and current flows in the second loop in a second direction and wherein the first antenna is coplanar with the second antenna. The method may further include detecting a magneto-acoustic marker by receiving a signal from the first or the second antenna.

In accordance with yet another aspect, the present invention provides a system for detecting a merchandise marker in which a first antenna includes a first circuit having a figure-eight shape. A second antenna includes a second circuit having a figure-eight shape. The first antenna is substantially coplanar and orthogonally positioned with respect to the second antenna. A controller sends a current through the first antenna and the second antenna. A detector detects a merchandise marker via the first or second antenna.

In accordance with yet another aspect, the present invention provides a system for detecting a radio-frequency marker in which a first antenna having a first conductive planar element is substantially coplanar with a second conductive planar element. A second antenna is substantially coplanar and orthogonally positioned with respect to the first antenna. The second antenna has a first conductive planar element substantially coplanar with a second conductive planar element.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE PREFERRED EMBODIMENTS

Figure 1:
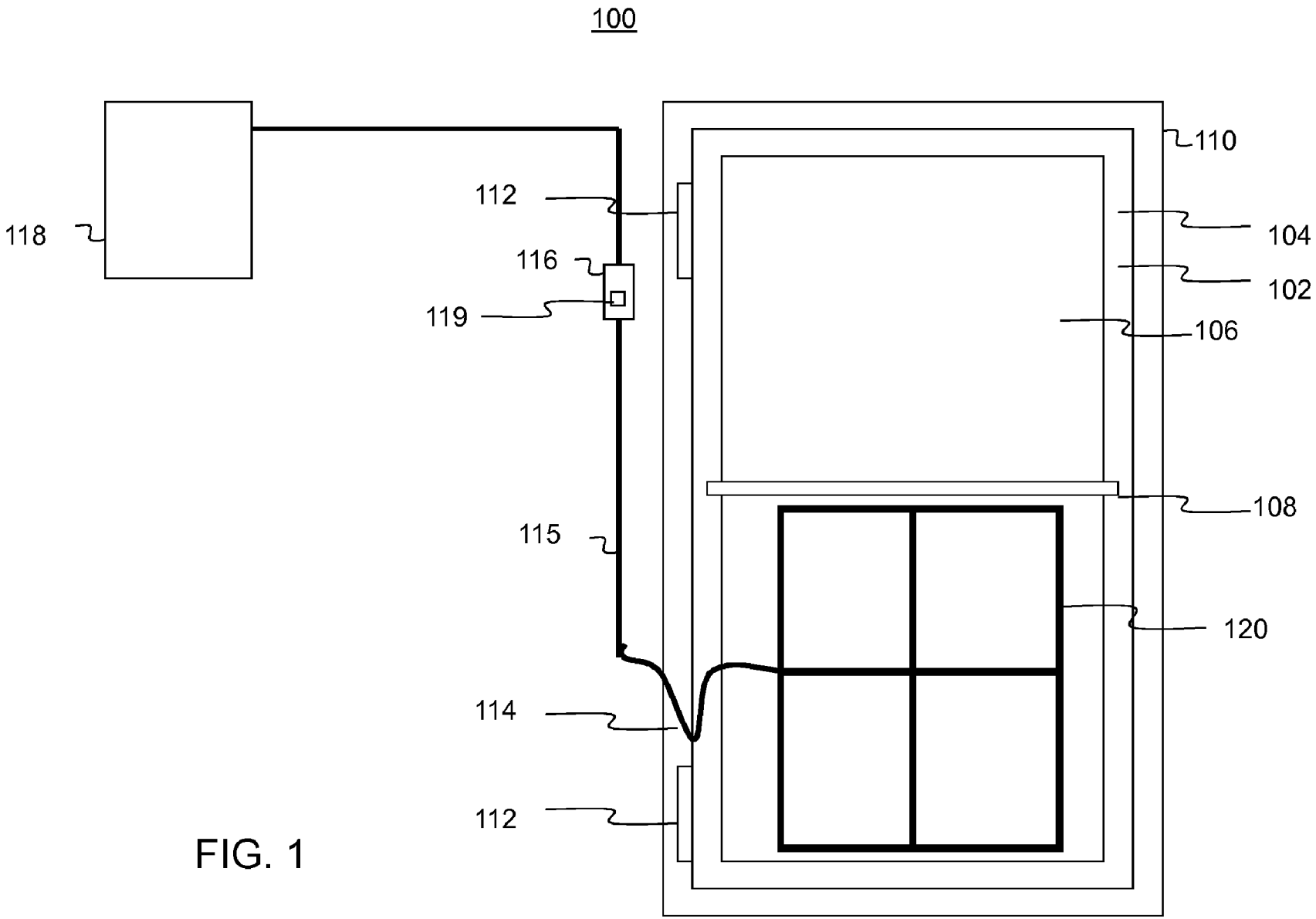
FIG. 1 is a diagram of a system for detecting merchandise surveillance markers, in one embodiment of the present invention.

Referring now to the drawing figures in which like reference designators refer to like elements, there is shown in FIG. 1 a diagram of a system for detecting merchandise surveillance markers constructed in accordance with the principles of the present invention and designated generally as "100". System 100 includes outer pane 102 of a door 104 comprising an inner window element 106. The outer pane 102 may be comprised of a conventional building material for a door such as wood or aluminum. The door 104 further includes a horizontal push bar 108 for pulling or pushing the door 104 open. The door 104 sits within and is hingably coupled to a threshold or door jam 110 via a pair of hinges 112 such that the door 104 may rotate about the hinges 112.

FIG. 1 further shows a transceiver antenna 120 located on a bottom window pane of the door 104. The transceiver antenna 120 and its functions are described in greater detail below. The transceiver antenna 120 is connected to a transceiver controller 118 via a conductive element 115 consisting of a wire, cable or other conductive line. The transceiver controller 118 includes a current generator for sending a current or currents through the transceiver antenna 120, a detector for detecting signals received from the transceiver antenna 120 (due to the presence of a merchandise surveillance marker, such as an LAS marker or an RFID marker), and a processor for making alarm decisions. In one embodiment of the present invention, the transceiver antenna 120 includes a resonant or tuned RLC circuit. It is also contemplated that the tuned RLC circuit can be provided as part of transceiver controller 118. A loop 114 in the conductive element 115 allows the conductive element 115 to hang loosely around the section of the door 104 that rotates when the door 104 is opened or closed. Also shown is an alarm 116 that, when activated by the transceiver controller 118 may produce an audible or visual indicator 119 of the presence of a merchandise surveillance marker.

In an embodiment of the present invention, the door 104 can be a side-hung swing door that is hung on either the left or right. Additionally, the antenna 120 can be mounted on either face of the door 104, embedded within the door 104, mounted to one side of a checkout aisle, or mounted adjacent to or beneath a conveyor belt to detect the passage of merchandise surveillance markers. In the case of double doors, antennas 120 can be installed on each side of the double door. In another embodiment of the present invention, the transceiver antenna 120 can have separate transmitter and receiver coils.

Although the present invention is primarily described herein with reference to EAS magnetoacoustic markers whose systems operate, for example, at 58 kHz, it is contemplated that the present invention can be implemented to detect Radio Frequency Identification (RFID) markers. In an embodiment of the present invention directed to RFID markers, the system 100 provides a method for detecting articles to which an RFID marker is affixed. RFID is an automatic identification method, relying on storing and remotely retrieving data using devices called RFID markers or transponders. An RFID marker is a small object that can be attached to or incorporated into a product, animal, or person. RFID markers contain silicon chips and antennas to enable them to receive and respond to radio-frequency queries from an RFID transceiver. Passive markers require no internal power source, whereas active markers require a power source. RFID markers can operate at low frequencies, such as 125-134.2 kHz and 140-148.5 kHz, high frequencies, such as 13.56 MHz, and ultra-high-frequencies, such as 868 MHz-928 MHz.

In this alternative embodiment of the present invention, the system 100 includes multiple directional or patch antennas 120 affixed to the door 104. A directional or patch antenna can comprise a conductive linear element such as a coil or a conductive planar element such as a metallic plate or shield. Phase canceling techniques can be used to produce the appropriate magnetic field for detecting corresponding merchandise surveillance markers. The controller 118 includes a current generator for sending a current or currents through the antenna 120, a detector for detecting signals received from the antenna 120, and a processor for making alarm decisions. When activated by the controller 118, the alarm 116 may produce an audible or visual indicator of the presence of a marker. In another embodiment of the present invention, various alternative types of antennas can be used for the antennas 120.

Figure 2:
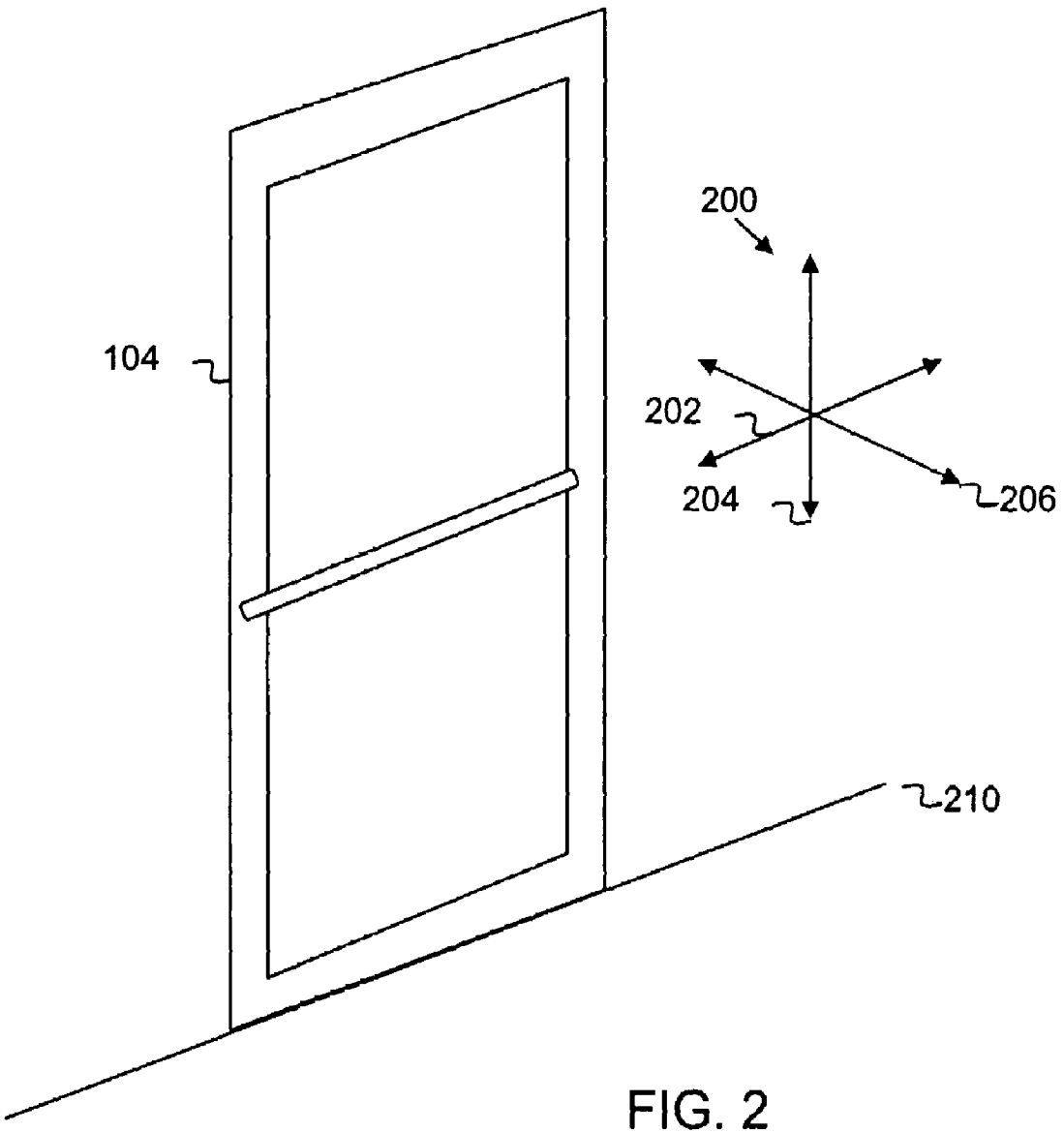
FIG. 2 is a diagram showing a coordinate system for identifying directions.

FIG. 2 is a diagram showing a coordinate system 200 for identifying directions in an exemplary embodiment. As used herein, directions refer to those directions defined in FIG. 2. The horizontal direction 202 refers to the direction parallel to the plane of the door 104 and the plane of the floor 210. The outwards or lateral direction 206 refers to the direction parallel to the plane of the floor 210 and perpendicular to the plane of the door 104. The vertical direction 204 refers to the direction parallel to the plane of the door 104 and perpendicular to the plane of the floor 210.

Figure 3:
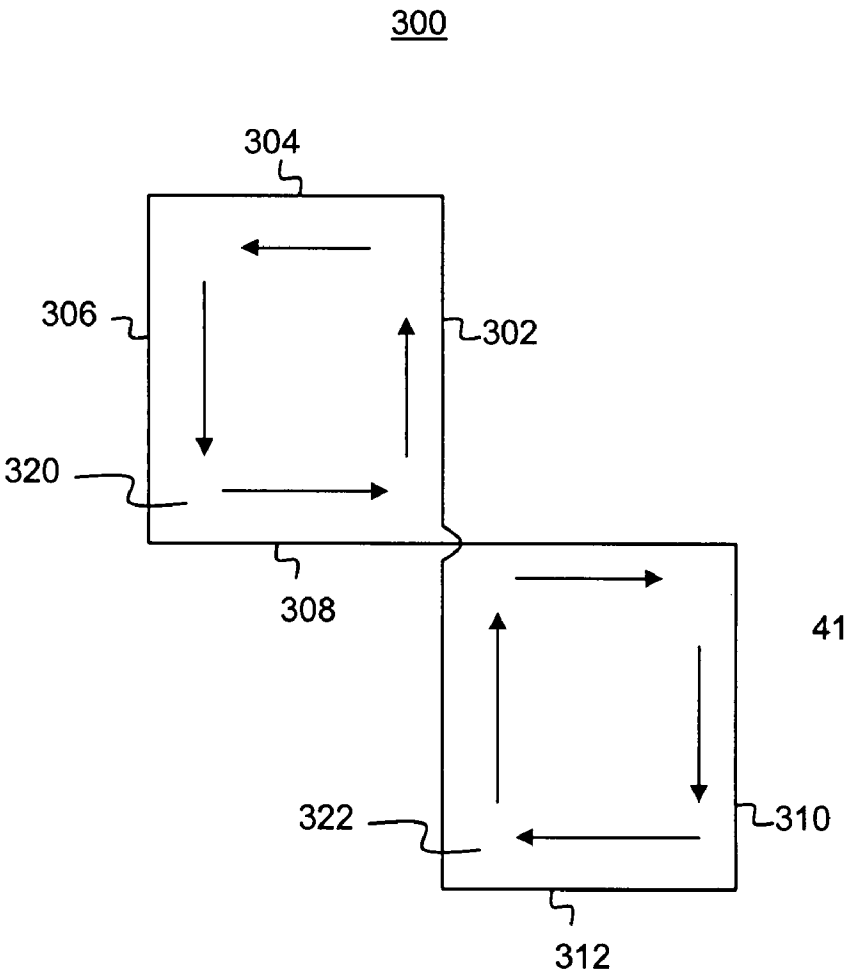
FIG. 3 is a diagram showing a first antenna for use in a system for detecting merchandise surveillance markers, in one embodiment of the present invention.

FIG. 3 is a diagram showing a first antenna 300 for use in a system for detecting merchandise surveillance markers, in one embodiment of the present invention. The antenna 300 comprises one half of the exemplary transceiver antenna 120 of FIG. 1. A complete circuit is formed in one plane by the antenna 300, through which a current is sent from transceiver controller 118. The antenna 300 comprises a conductive element consisting of a wire, cable or other conductive line such that when a current is run through the conductive element, a corresponding magnetic field is produced.

Also shown is the substantially figure-eight form of the antenna 300. Generally, a figure-eight form includes two separate areas 320, 322 encompassed by two separate loops of the circuit of the antenna 300. In one embodiment of the present invention, the two separate areas 320, 322 encompassed by the circuit of the antenna 300 are of substantially the same size. In another embodiment, the two separate areas 320, 322 encompassed by the circuit of the antenna 300 are of unequal size. Further, although FIG. 3 shows rectangular-shaped loops, the present invention supports other shapes, such as an ellipse, a circle, a pear shape, a kidney shape, etc. In yet another embodiment of the present invention, the two separate areas 320, 322 are of substantially unequal size. In this embodiment, the smaller area would be encompassed by one or more additional coils or loops of the conductive element 115, thereby increasing the magnetic field strength produced by the smaller area, so as to make the magnetic field strengths produced by both areas 320, 322 substantially equal. In yet another embodiment of the present invention, smaller or reduced areas 320, 322, when operating at ultra-high-frequencies, such as 868 MHz-928 MHz, produce a magnetic field commensurate with larger areas 320, 322 used with lower frequency settings. In this way, the size of areas 320, 322 can be modified to larger or smaller magnitudes, while still producing similar magnetic field strengths, as long as the operating frequency of the antenna 300 is modified accordingly.

Also shown in FIG. 3 are a series of arrows showing current flow within the antenna 300. The arrows show that current flows up the circuit segment 302, turns to the left through circuit segment 304, turns downward on circuit segment 306, turns to the right on circuit segment 308, turns downward on circuit segment 310 and turns to the left on circuit segment 312 to complete the circuit. Note that the conductive element forming segment 302 is positioned around the conductive element forming segment 308 to avoid creating a short circuit. The configuration of the current flow results in a magnetic flux exiting in the opposite direction for area 320 as compared to 322.

Figure 4:
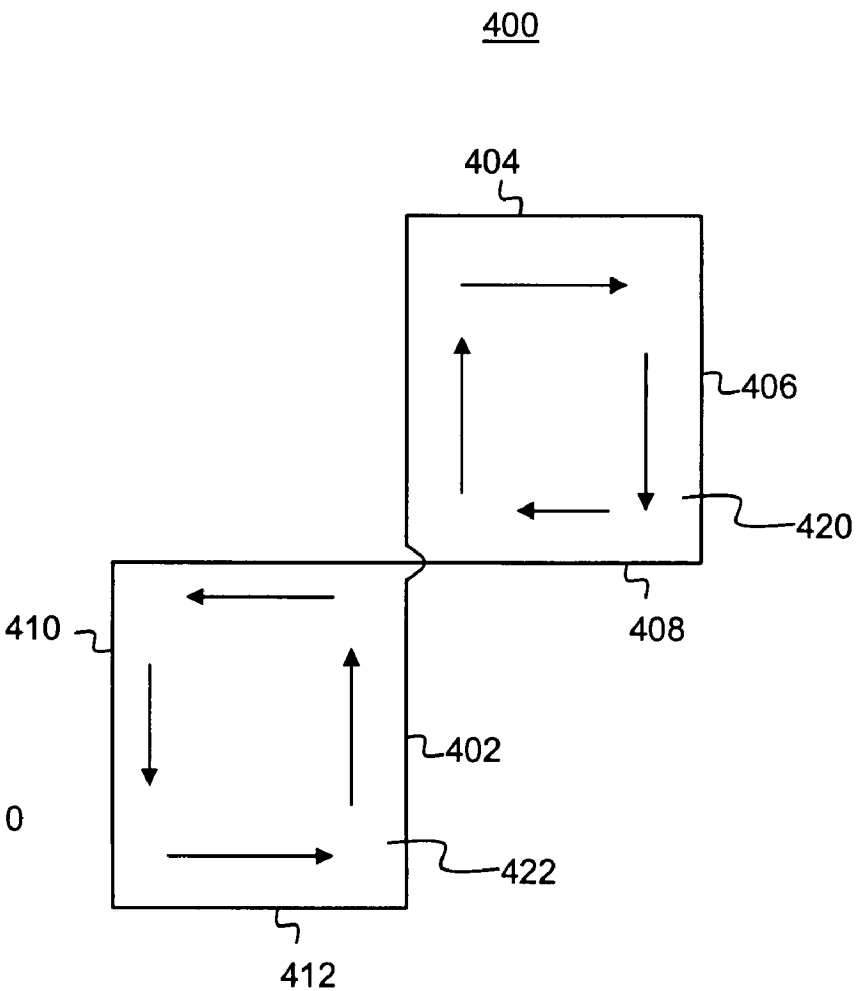
FIG. 4 is a diagram showing a second antenna for use in a system for detecting merchandise surveillance markers, in one embodiment of the present invention.

FIG. 4 is a diagram showing a second antenna 400 for use in a system for detecting merchandise surveillance markers. The antenna 400 comprises the other half of the exemplary transceiver antenna 120 shown in FIG. 1. Like antenna 300, a complete circuit is formed in one plane by the antenna 400, through which a current is sent from transceiver controller 118. The antenna 400 comprises a conductive element.

Also shown is the substantially figure-eight form of the antenna 400, similar to antenna 300. In one embodiment of the present invention, the two separate areas 420, 422 encompassed by the circuit of the antenna 400 are of substantially the same size. In another embodiment, the two separate areas 420, 422 encompassed by the circuit of the antenna 400 are of unequal size. In yet another embodiment, the two separate areas 420, 422 encompassed by the circuit of the antenna 400 are of equal size to areas 320, 322 of FIG. 3. In yet another embodiment of the present invention, the two separate areas 420, 422 are of substantially unequal size. In this embodiment, the smaller area would be encompassed by one or more additional coils or loops of the conductive element 115, thereby increasing the magnetic field strength produced by the smaller area, so as to make the magnetic field strengths produced by both areas 420, 422 substantially equal.

Also shown in FIG. 4 are a series of arrows showing current flow within the antenna 400. The arrows indicate that current flows up the circuit segment 402, turns to the right through circuit segment 404, turns downward on circuit segment 406, turns to the left on circuit segment 408, turns downward on circuit segment 410 and turns to the right on circuit segment 412 to complete the circuit. Note that conductive element forming segment 402 is positioned around segment 408 to avoid creating a short circuit. The configuration of the current flow results in a magnetic flux exiting in the opposite direction-from area 420 as compared to 422.

Figure 5:
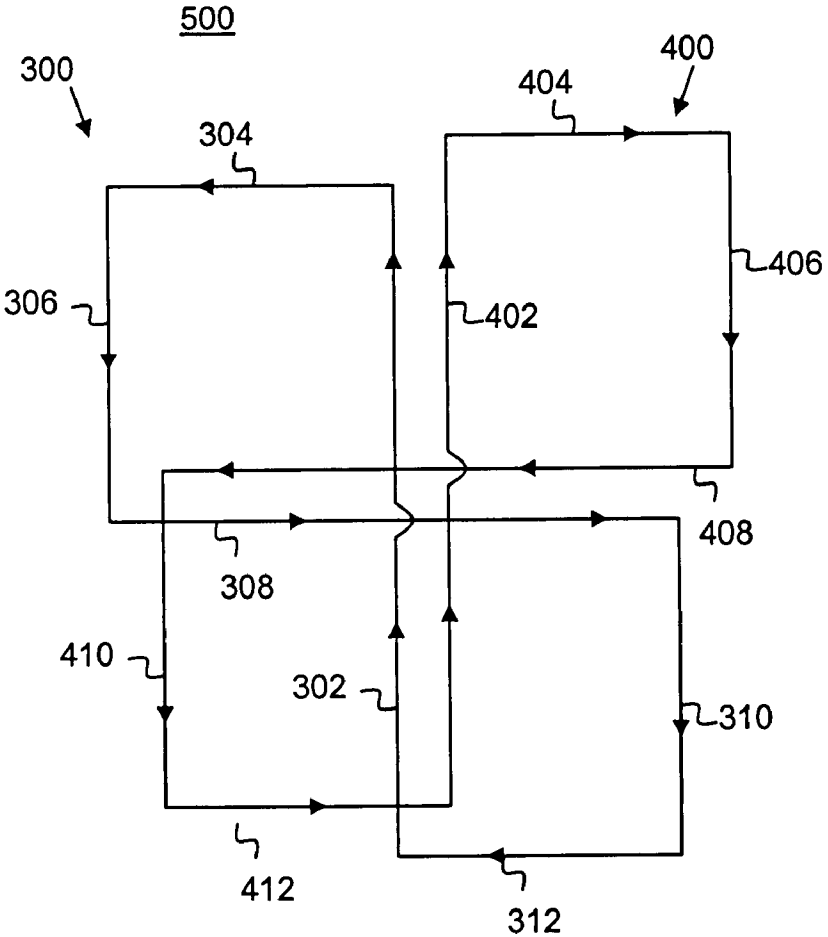
FIG. 5 is a diagram showing the first antenna of FIG. 3 and the second antenna of FIG. 4 integrated into single transceiver for use in a system for detecting merchandise surveillance markers, in one embodiment of the present invention.

FIG. 5 is a diagram showing the first antenna 300 of FIG. 3 and the second antenna 400 of FIG. 4 integrated into single transceiver 500 for use in a system for detecting merchandise surveillance markers, in one embodiment of the present invention. In short, FIG. 5 shows antennas 300, 400 superimposed on each other in a substantially coplanar manner such that both antennas 300 and 400 occupy the same overall area. FIG. 5 depicts the two antennas 300, 400 slightly offset so as to better show current flow arrows. However, antennas 300 and 400 are actually positioned so that the two antennas are orthogonally oriented (rotated approximately 90 degrees) with respect to one another. In one embodiment of the present invention, antenna 300 is placed on top of or overlaid onto antenna 400, while in another embodiment antenna 400 is placed on top of antenna 300.

FIG. 5 shows that circuit segments 302 and 402 have current flow in the same direction which would amplify the magnetic flux emanating from the area surrounding circuit segments 302 and 402. On the other hand, FIG. 5 shows that circuit segments 308 and 408 have current flow in the opposite direction which would cancel or zero out the magnetic flux emanating from the area surrounding circuit segments 308 and 408. As is shown, the two antennas are positioned so that the two antennas are orthogonally oriented (rotated approximately 90 degrees) with respect to one another. All other magnetic fields remain as described with respect to FIGS. 3 and 4 above. Thus, the end result of stacking antenna 300 and 400 together is an overall magnetic flux identical to the magnetic flux each antenna transmits alone, with the exception of: a) a reduction or elimination of magnetic flux in the area surrounding circuit segments 308 and 408 and b) a magnification of magnetic flux in the area surrounding circuit segments 302 and 402.

Figure 6:
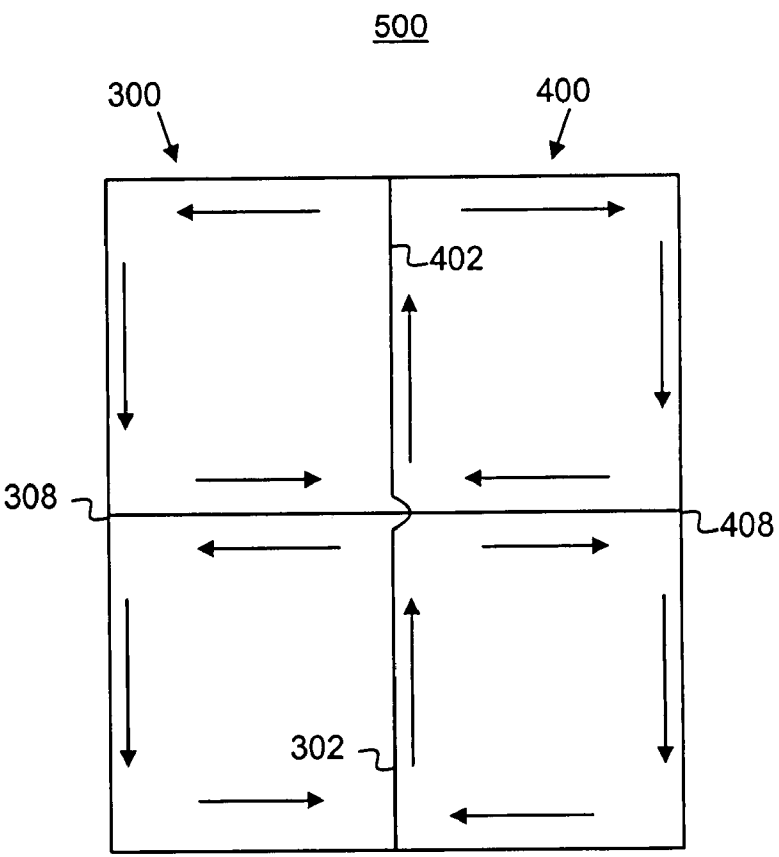
FIG. 6 is a diagram showing another view of the single transceiver of FIG. 5.

FIG. 6 is a diagram showing another view of the single transceiver 500 of FIG. 5. FIG. 6 depicts the two antennas 300, 400 stacked and aligned with each other, as opposed to slightly offset as in FIG. 5. The arrows in FIG. 6 show current flow within each circuit segment. As explained above, the resultant magnetic field produced by the single transceiver 500 is an overall magnetic flux as described for each antenna, with the exception of a reduction of magnetic flux in the area surrounding circuit segments 308 and 408 and a magnification of magnetic flux in the area surrounding circuit segments 302 and 402.

In an embodiment of the present invention, the controller 118 periodically changes the direction of the current running through one antenna segment with respect to the other antenna segment so as to periodically alternate those areas having reduced and magnified magnetic flux. For example, if controller 118 switches the current running through antenna 300 to the opposite direction as depicted in FIG. 5, then the resultant magnetic field produced by the single transceiver 500 would be the overall magnetic flux as described above for FIG. 5, with the exception of a magnification of magnetic flux in the area surrounding circuit segments 308 and 408 (since current would be running in the same direction in both segments) and a reduction or elimination of magnetic flux in the area surrounding circuit segments 302 and 402 (since current would be running in the opposite direction in both segments). Therefore, as the current running through antenna 300 is alternated, segment 302, 402 periodically alternates between reduced magnetic flux and amplified magnetic flux—likewise, segment 308, 408 periodically alternates between reduced magnetic flux and amplified magnetic flux. Of note, the descriptions herein of a direction of the current flow are simplified to aid understanding and provide ease of explanation. It is presumed that one of ordinary skill would understand that the current flowing in the antenna segments, such as segments 302 and 402, is an alternating current (AC) and that the directional current arrows shown in the drawing figures depict the current direction during a ½ cycle of the AC waveform.

Thus, in this embodiment, the weak part of the magnetic field (i.e., that section of the single transceiver 500 where collinear circuit segments run current in opposite directions) is mitigated by alternately emanating a weak (or non-existent) and a magnified magnetic field. In this manner, the magnetic field produced by the system 100 can minimize the exposure of the weak magnetic field and optimize its ability to detect merchandise surveillance markers.

Figure 7:
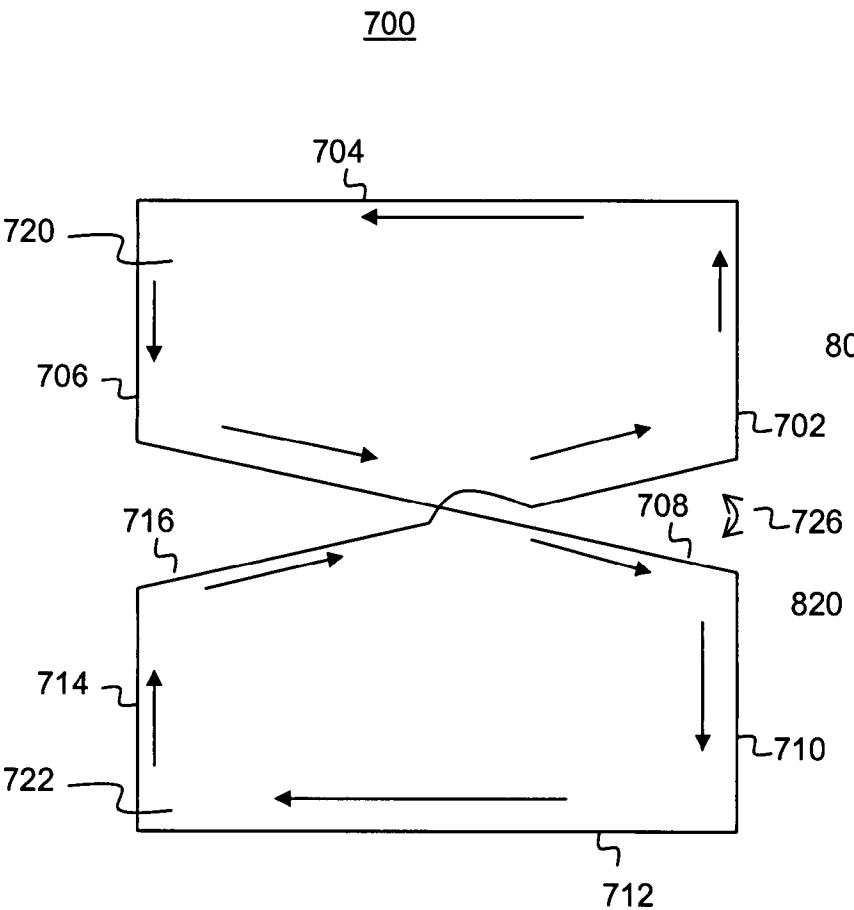
FIG. 7 is a diagram showing a first antenna for use in a system for detecting merchandise surveillance markers, in one embodiment of the present invention.

FIG. 7 is a diagram showing a first antenna 700 for use in a system for detecting merchandise surveillance markers, according to the principles of the present invention. The antenna 700 may comprise one half of the exemplary transceiver antenna 120 of FIG. 1. A complete circuit is formed in one plane by the antenna 700, through which a current is sent from transceiver controller 118. The antenna 700 comprises a conductive element.

Also shown is the substantially figure-eight form of the antenna 700. In one embodiment of the present invention, the two separate areas 720, 722 encompassed by the circuit of the antenna 700 are of substantially the same size. In another embodiment, the two separate areas 720, 722 encompassed by the circuit of the antenna 700 are of unequal size. Further, although FIG. 3 shows rectangular-shaped loops, the present invention supports other shapes, such as an ellipse, a circle, a pear shape, a kidney shape, etc. It is noted that the angle 726 between the two areas 720, 722 is greatly exaggerated for purposes of showing current flow arrows. The actual angle 726 between the two areas 720, 722 may be substantially zero so as to appear as two rectangles adjacent to each other.

Also shown in FIG. 7 is a series of arrows showing current flow within the antenna 700. The arrows show that current flows up the circuit segment 702, turns to the left through circuit segment 704, turns downward on circuit segment 706, turns to the right on circuit segment 708, turns downward on circuit segment 710, turns to the left on circuit segment 712, turns upwards on circuit segment 714 and turns to the right on segment 716 to complete the circuit. Note that the conductive element forming segment 716 is positioned around the conductive element forming segment 708 to avoid creating a short circuit. The configuration of the current flow results in a magnetic flux exiting in the opposite direction from area 720 as compared to 722.

Figure 8:
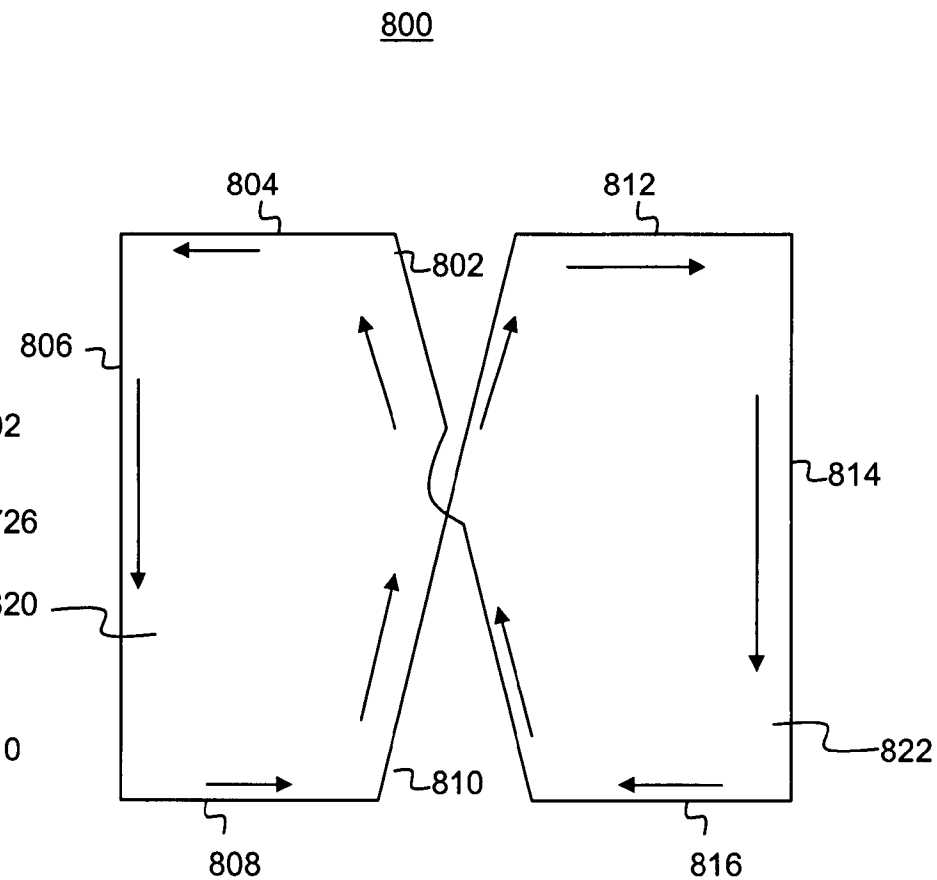
FIG. 8 is a diagram showing a second antenna for use in a system for detecting merchandise surveillance markers, in one embodiment of the present invention.

FIG. 8 is a diagram showing a second antenna 800 for use in a system for detecting merchandise surveillance markers, in one embodiment of the present invention. The antenna 800 comprises the other half of the exemplary transceiver antenna 120 of FIG. 1. Like antenna 700, a complete circuit is formed in one plane by the antenna 800, through which a current is sent from transceiver controller 118. The antenna 800 comprises a conductive element.

Also shown is the substantially figure-eight form of the antenna 800, similar to antenna 700. In one embodiment of the present invention, the two separate areas 820, 822 encompassed by the circuit of the antenna 800 are of substantially the same size. In another embodiment, the two separate areas 820, 822 encompassed by the circuit of the antenna 800 are of unequal size. In yet another embodiment, the two separate areas 820, 822 encompassed by the circuit of the antenna 800 are of equal size to areas 720, 722 of FIG. 7.

Also shown in FIG. 8 are a series of arrows showing current flow within the antenna 800. The arrows show that current flows up the circuit segment 802, turns to the left through circuit segment 804, turns downward on circuit segment 806, turns to the right on circuit segment 808, turns upward on circuit segment 810, turns to the right on circuit segment 812, turns downwards on circuit segment 814 and turns to the left on segment 816 to complete the circuit. Note that the conductive element forming segment 802 is positioned around the conductive element forming segment 810. The configuration of the current flow results in a magnetic flux radiating in the opposite direction from area 820 as compared with area 822.

Figure 9:
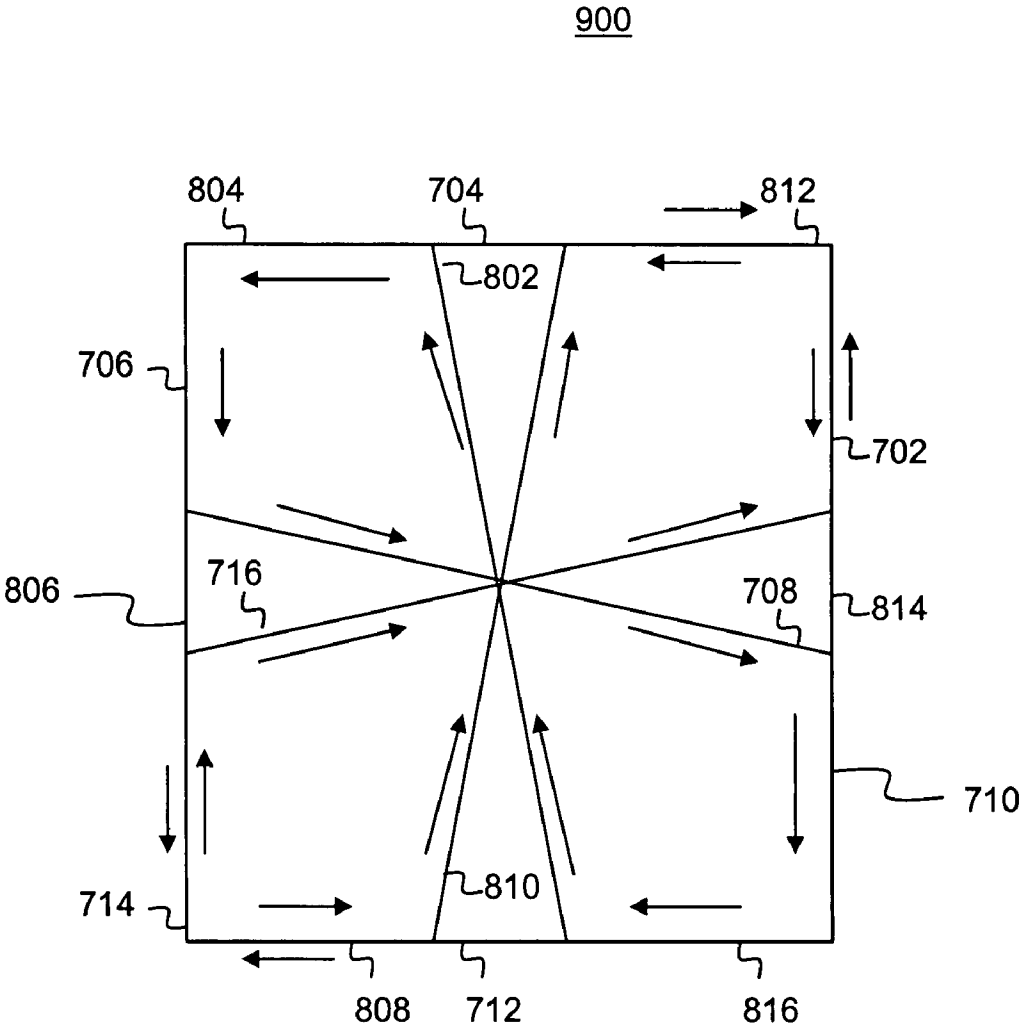
FIG. 9 is a diagram showing the antenna of FIG. 7 and the antenna of FIG. 8 integrated into single compound transceiver for use in a system for detecting merchandise surveillance markers.

FIG. 9 is a diagram showing the first antenna 700 of FIG. 7 and the second antenna 800 of FIG. 8 integrated into single transceiver 900 for use in a system for detecting merchandise surveillance markers, in one embodiment of the present invention. In short, FIG. 9 shows antennas 700, 800 superimposed on each other in a substantially coplanar manner such that both antennas 700 and 800 occupy the same overall area. FIG. 9 depicts the two antennas 700, 800 slightly offset so as to better show current flow arrows. As is shown, the two antennas 700 and 800 are positioned so that the two antennas are orthogonally oriented (rotated approximately 90 degrees) with respect to one another. In one embodiment of the present invention, antenna 700 is placed on top of or overlaid onto antenna 700, while in another embodiment antenna 800 is placed on top of antenna 700. In another embodiment of the present invention, antenna 700 is placed on top of and aligned with antenna 800, while in another embodiment antenna 800 is placed on top of and aligned with antenna 700 (see FIG. 9 below for a more detailed description of this embodiment).

The arrows of FIG. 9 show current flow within each circuit segment. FIG. 9 shows that circuit segments 804 and 704, as well as circuit segments 706 and 806 have current flow in the same direction which would amplify the magnetic flux emanating from the area surrounding these circuit segments. On the other hand, FIG. 9 also shows that circuit segments 806 and 714 as well as 808 and 712 have current flow in the opposite direction which would cancel or zero out the magnetic flux emanating from the area surrounding these circuit segments. Of note, although FIGS. 7-9 show antennas 700 and 800 shaped with segments 708, 716, 802 and 810 forming obtuse angles with respect to their corresponding outer walls, e.g., segments 702 and 706, subject to the bend radius of the wires forming the circuit, it is contemplated that segments 708, 716, 802 and 810 can also be arranged to substantially form right angles with respect to outer wall segments.

Accordingly, it is noted that the shape of antennas 700 and 800 as shown in FIGS. 7-9 is for illustrative purposes only.

Further, circuit segments 812 and 704 as well as 814 and 702 have current flow in the opposite direction, thereby canceling out the magnetic flux in these areas, and circuit segments 814 and 710, as well as circuit segments 712 and 816 have current flow in the same direction, thereby amplifying the magnetic flux in these areas. Also, since circuit segments 708 and 716, as well as 810 and 802 are substantially collinear, the magnetic flux in these areas is amplified. Thus, the resultant magnetic field produced by the single transceiver 900 includes: a) an amplified magnetic flux around the inside segments of all quadrants of the single transceiver 900, b) a null or reduced magnetic field in the outer segments of the upper right and lower left quadrants and c) a magnetic field produced by one antenna in all other areas of the single transceiver 900.

In an embodiment of the present invention, the controller 118 periodically changes the direction of the current running through one antenna so as to periodically alternate those areas having reduced and magnified magnetic flux. For example, if controller 118 switches the current running through antenna 700 to the opposite direction as depicted in FIG. 7, then the resultant magnetic field produced by the single transceiver 900 would include: a) an amplified magnetic flux around the inside segments of all quadrants of the single transceiver 900, b) a null or reduced magnetic field in the outer segments of the upper left and lower right quadrants and c) a magnetic field produced by one antenna in all other areas of the single transceiver 900. Therefore, as the current running through antenna 700 is alternated, the outer segments of the upper right and lower left quadrants periodically alternate between reduced magnetic flux and amplified magnetic flux—likewise, the outer segments of the upper left and lower right quadrants periodically alternates between reduced magnetic flux and amplified magnetic flux.

The embodiments of the present invention, as depicted in single transceivers 500 and 900, allow for the production of a "focused" magnetic field strong enough to detect merchandise surveillance markers but having an amplitude that is low enough to avoid the detection of merchandise surveillance markers that may be situated near the detector, as in a small retail store where floor space is largely reduced. Further, the embodiments of the present invention advantageously allow for the production of an adequate magnetic field using reduced power and a small antenna footprint.

Furthermore, the use of figure-eight conductive elements or coils as receivers increases the detection capability of the merchandise surveillance system 100. Distant signal sources affect both halves of a figure-eight coil equally, thereby creating opposing currents in either half of the coil, which cancel themselves out. Thus, environmental signal sources cancel themselves out, whereas a merchandise surveillance marker that is close to the magnetic field will normally be closer to one loop than another, thereby inducing a larger current in one coil, resulting in a detection. Therefore, merchandise surveillance markers near the magnetic field have an improved signal-to-noise ratio over environmental noise. The use of figure-eight conductive elements or coils as transmitters decreases interference potential since the field from each half of the coil will be roughly equal from a large distance, but out of phase, and will therefore self-cancel.

The embodiments of the present invention are also beneficial for the mounting of a system 100 onto a door 104 having a metal frame as de-tuning of the magnetic field is reduced or eliminated. Magnetic flux from one half of an antenna (such as half 320 of antenna 300) generates a current in the door frame 102 in the direction opposite of the current in that half of the antenna 300. However, magnetic flux from the other half of the antenna (such as half 322 of antenna 300) generates a current in the door frame 102 in the other direction, thereby canceling out the previous current induced in the door frame 102. Thus, current induced into the doorframe 102 by the two halves of a figure-eight conductive element oppose each other and cancel out, meaning no magnetic field is lost through coupling to the metal doorframe 102 and likewise, no detuning of the antennas for the same reason.

Thus, in this embodiment, the weak part of the magnetic field, i.e., that section of the single transceiver 900 where collinear circuit segments run current in opposite directions is mitigated by alternately emanating a weak (or non-existent) and a magnified magnetic field. In this manner, the magnetic field produced by the system 100 can minimize the exposure of the weak magnetic field and optimize its ability to detect merchandise surveillance markers.

Figure 10:
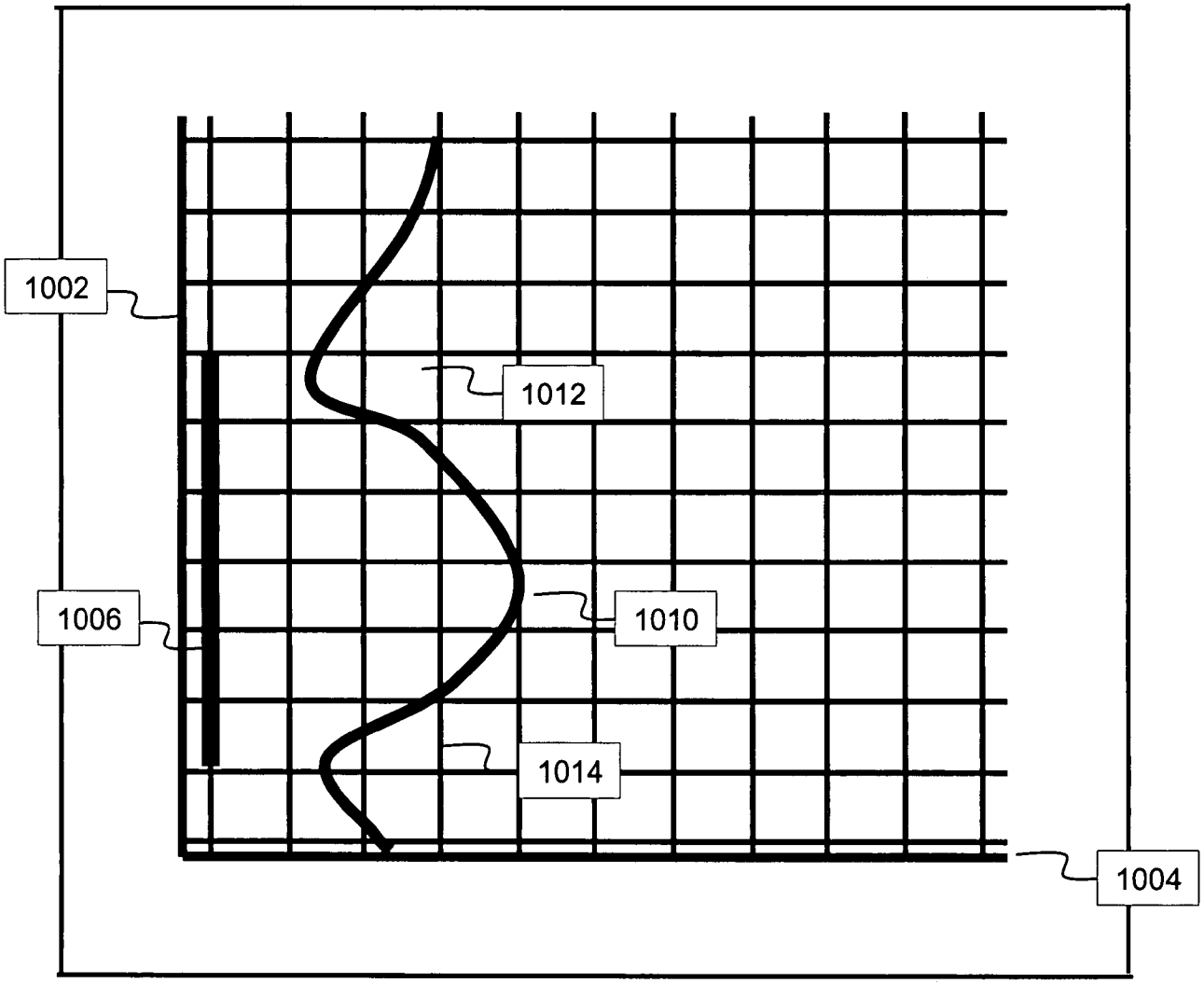
FIG. 10 is a graph showing magnetic field strength for a single antenna in the vertical direction.

FIG. 10 is a graph showing magnetic field strength for a single antenna 700 in the vertical direction 204 (see FIG. 2). The graph of FIG. 10 shows height on the y-axis 1002 and magnetic field strength on the x-axis 1004. The placement of the antenna 700 is shown at 1006. The graph shows that the field strength of the antenna 700 peaks 1010 mid-way up the antenna 300 and tapers off at the top and bottom edges 1012, 1014 of the antenna 700.

Figure 11:
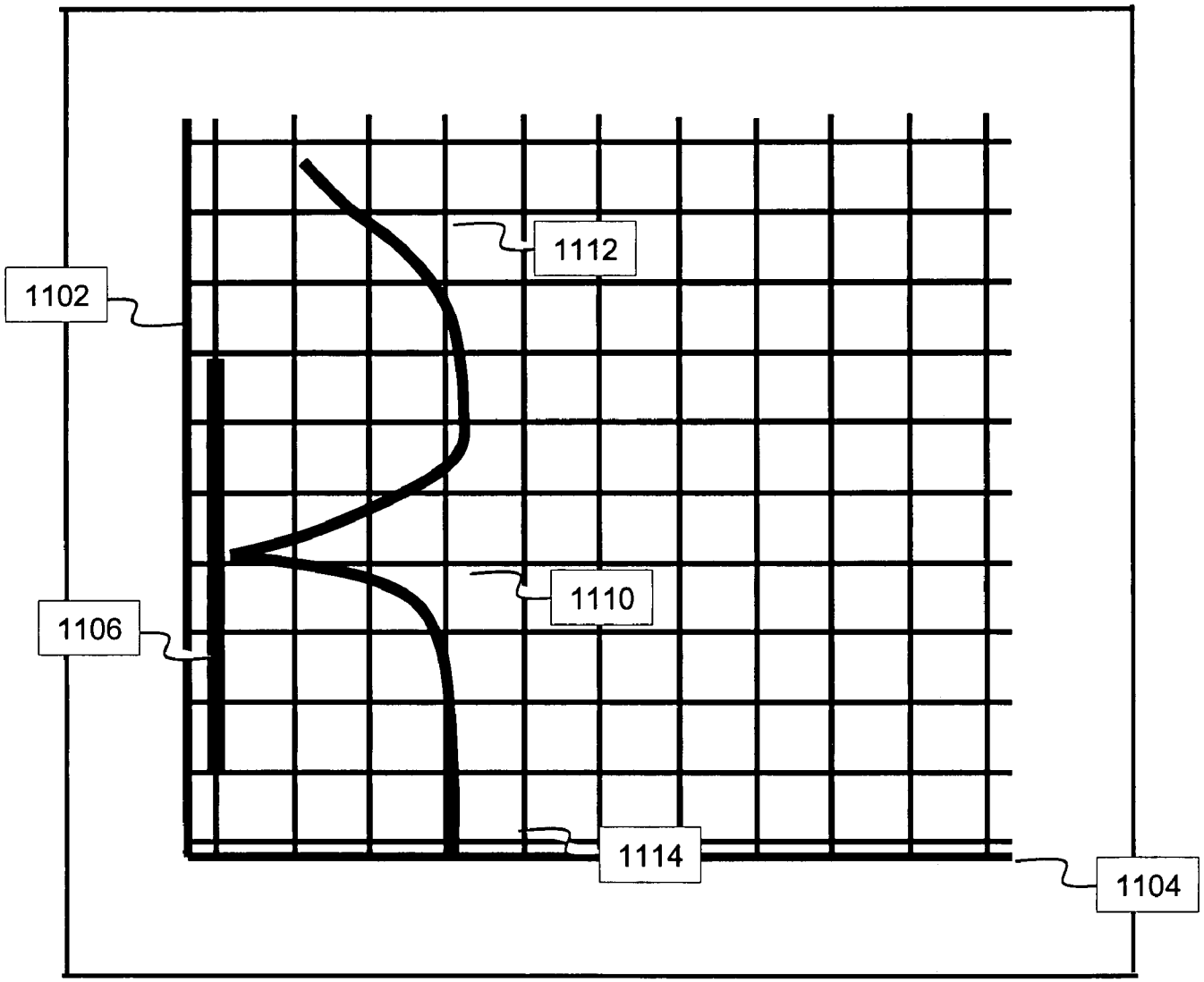
FIG. 11 is a graph showing magnetic field strength for a single antenna in the horizontal direction.

FIG. 11 is a graph showing magnetic field strength for a single antenna 700 in the horizontal direction 202. The graph of FIG. 11 shows horizontal distance on the y-axis 1102 and magnetic field strength on the x-axis 1104. The placement of the antenna 700 is shown at 1106. The graph shows that the field strength of the antenna 700 exhibits a valley 1110 mid-way across the antenna 700 and tapers off at the side edges 1112, 1114 of the antenna 700.

Figure 12:
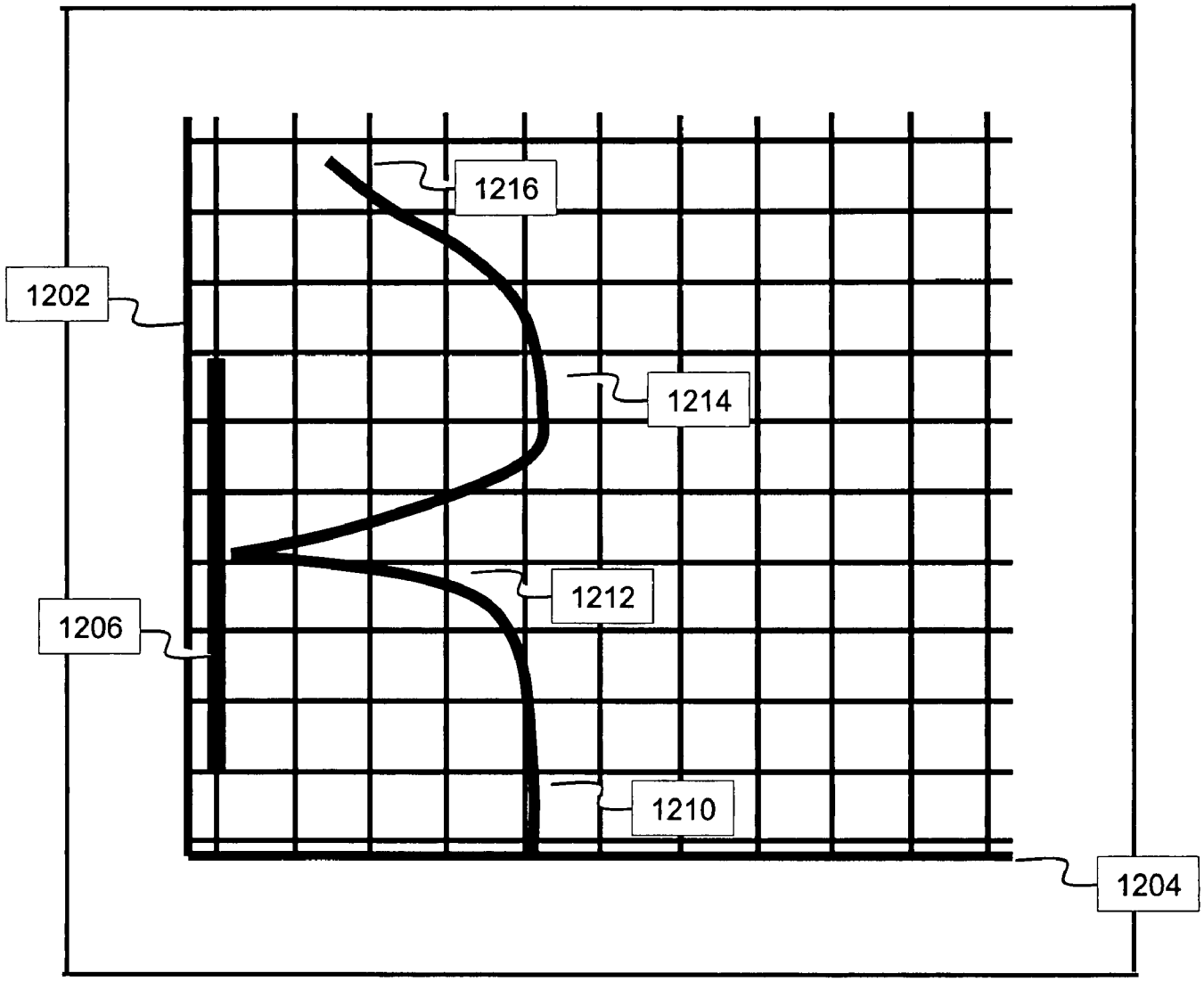
FIG. 12 is a graph showing magnetic field strength for a single antenna in the lateral direction.

FIG. 12 is a graph showing magnetic field strength for a single antenna 700 in the lateral direction 206. The graph of FIG. 12 shows lateral distance on the y-axis 1202 and magnetic field strength on the x-axis 1204. The placement of the antenna 700 is shown at 1206. The graph shows that the field strength of the antenna 700 is high 1210 at the antenna 700, exhibits a valley 1212 at a certain distance from the antenna 700, increases 1214 after the valley and subsequently tapers off 1216 as the distance from the antenna 700 continues to increase.

Figure 13:
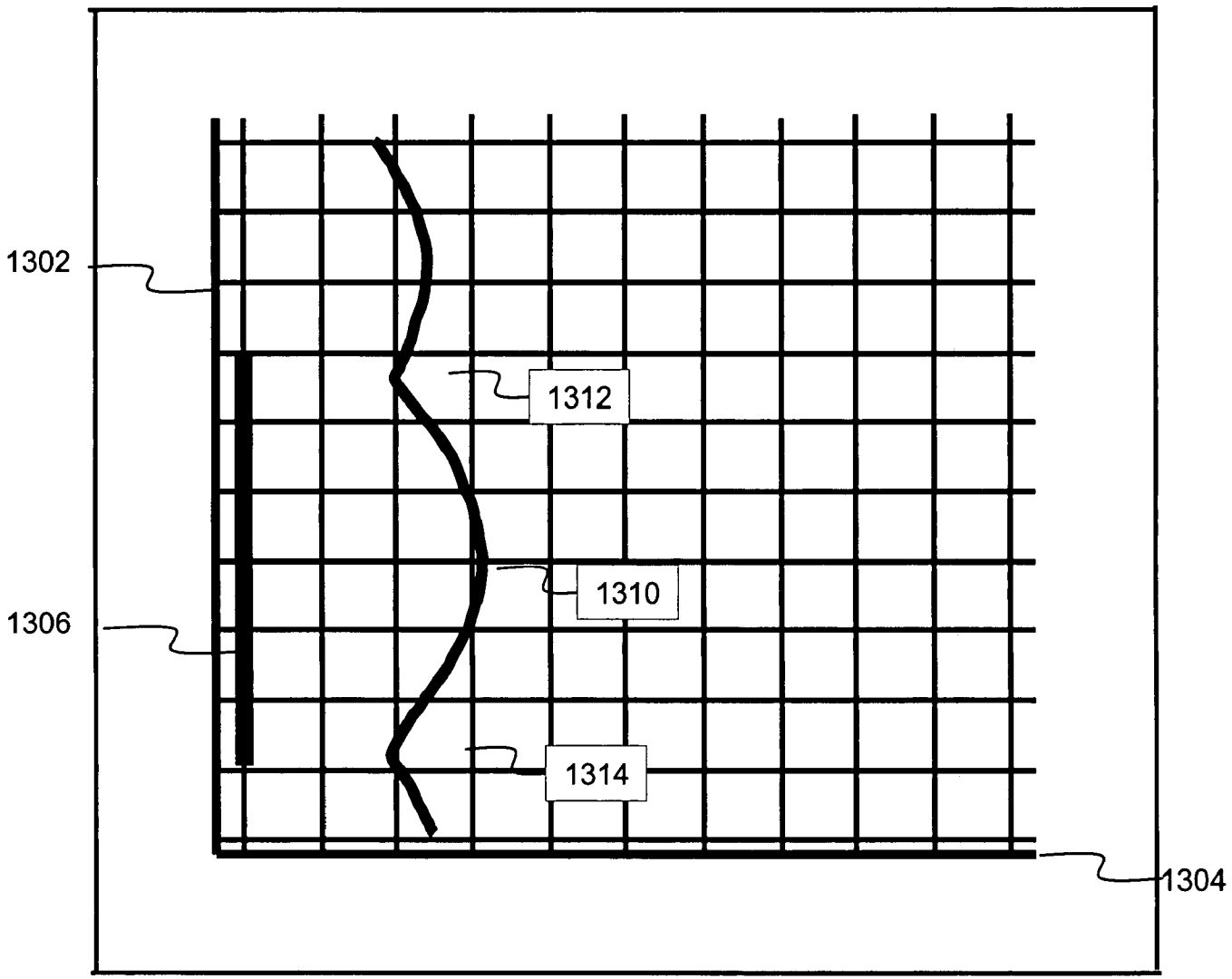
FIG. 13 is a graph showing magnetic field strength for a compound transceiver antenna in the vertical direction.

FIG. 13 is a graph showing magnetic field strength for a compound transceiver antenna 900 (such as the compound antenna shown in FIG. 6) in the vertical direction 204 (see FIG. 2). The graph of FIG. 13 shows height on the y-axis 1302 and magnetic field strength on the x-axis 1304. The placement of the antenna 900 is shown at 1306. The graph shows that the field strength of the antenna 900 peaks 1310 mid-way up the antenna 900 and decreases but remains substantial at the top and bottom edges 1312, 1314 of the antenna 900. Comparing the graph of FIG. 13 to the graph of FIG. 10 shows increased magnetic field strength at the top and bottom edges 1312, 1314 of the antenna 900.

Figure 14:
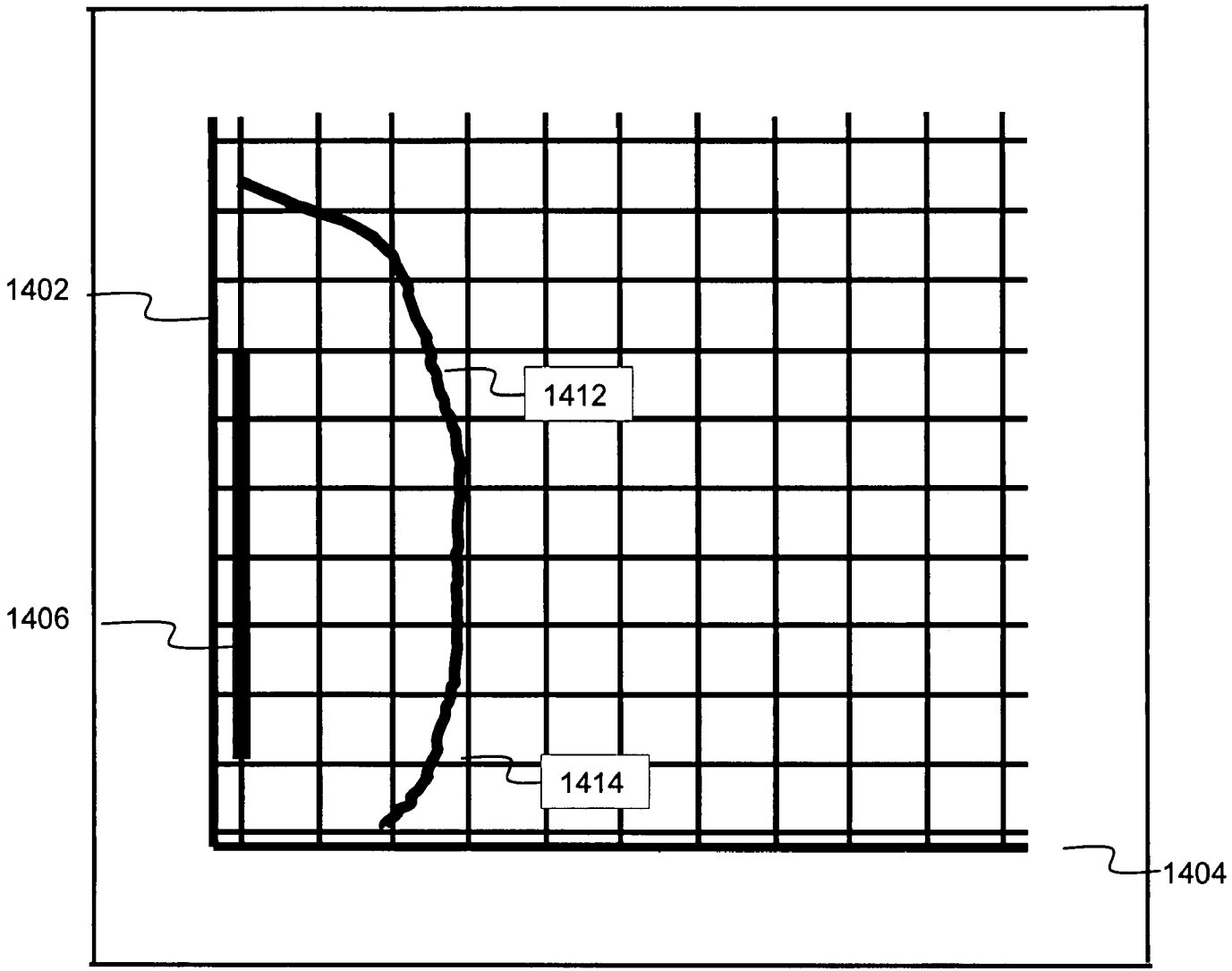
FIG. 14 is a graph showing magnetic field strength for a compound transceiver antenna in the horizontal direction.

FIG. 14 is a graph showing magnetic field strength for a compound transceiver antenna 900 in the horizontal direction 202. The graph of FIG. 14 shows horizontal distance on the y-axis 1402 and magnetic field strength on the x-axis 1404. The placement of the antenna 900 is shown at 1406. The graph shows that the field strength of the antenna 900 is relatively constant across the antenna 900 and tapers off slightly at the side edges 1412, 1414 of the antenna 900. Comparing the graph of FIG. 14 to the graph of FIG. 11 shows that valley 1110 (in FIG. 11) is gone in FIG. 14. FIG. 14 shows a more uniform field strength than that shown in FIG. 11.

Figure 15:
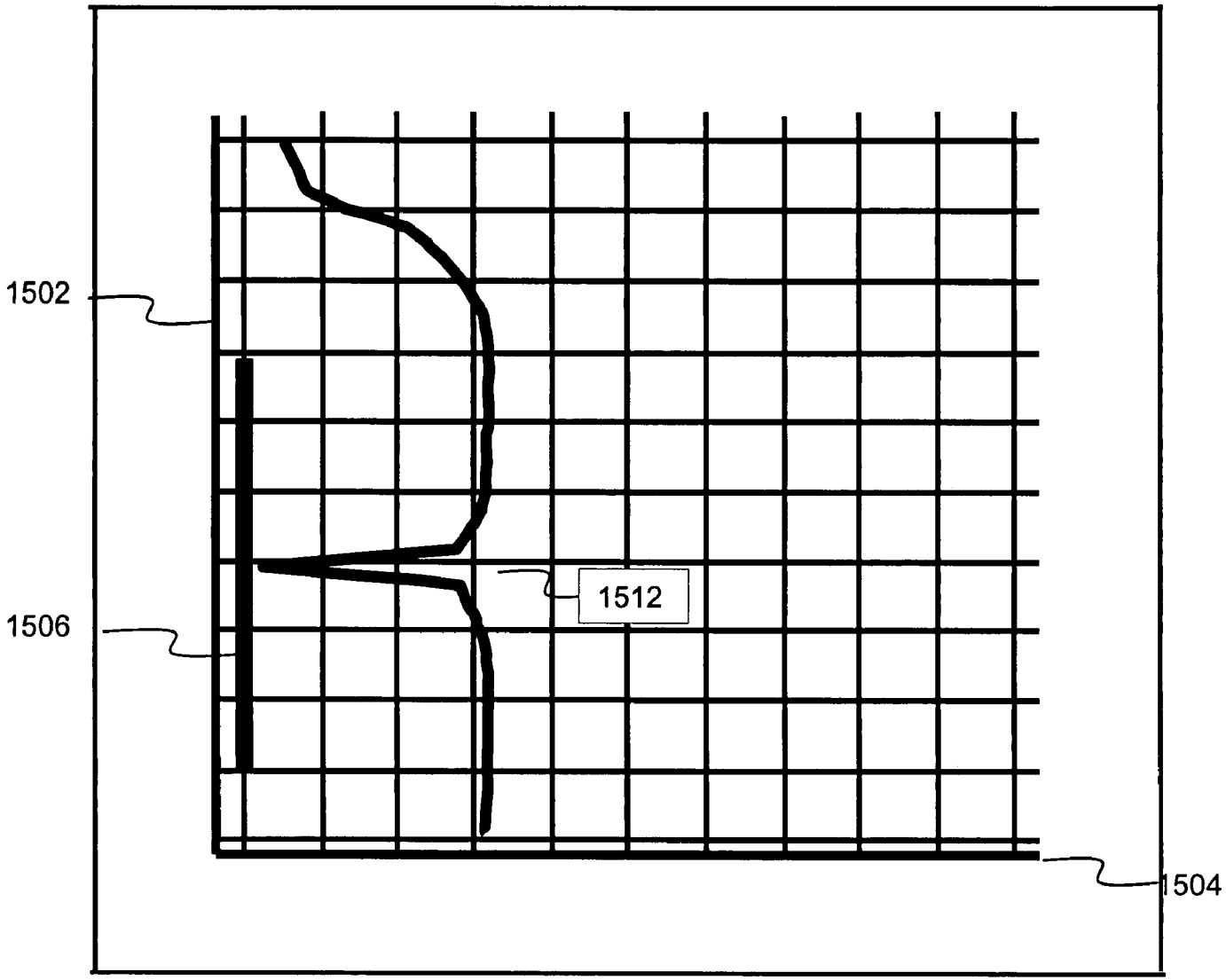
FIG. 15 is a graph showing magnetic field strength for a compound transceiver antenna in the lateral direction.

FIG. 15 is a graph showing magnetic field strength for a compound transceiver antenna 900 in the lateral direction 206. The graph of FIG. 15 shows lateral distance on the y-axis 1502 and magnetic field strength on the x-axis 1504. The placement of the antenna 900 is shown at 1506. The graph shows that the field strength of the antenna 900 is almost constant within a range of distance from the antenna 900, except for a narrow valley 1512 at a certain distance from the antenna 900. Comparing the graph of FIG. 15 to the graph of FIG. 12 shows increased magnetic field strength at all distances from the antenna 900 except for a narrow valley 1512.

The embodiments of the invention can take the form of an entirely hardware embodiment, an entirely software embodiment or an embodiment containing both hardware and software elements. It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are possible in light of the above teachings without departing from the scope and spirit of the invention, which is limited only by the following claims.

We claim:

1. A transceiver for detecting a merchandise marker, comprising:

a first antenna comprising a first circuit having a first loop defining a first area and a second loop defining a second area substantially coplanar with the first area; and a second antenna substantially coplanar and orthogonally positioned with respect to the first antenna, the second antenna comprising a second circuit having a third loop defining a third area and a fourth loop defining a fourth area substantially coplanar with the third area, the second antenna being configured to receive a driving signal that is different from a driving signal received by the first antenna.

2. The transceiver of claim 1, wherein the first area is substantially equal in size to the second area.

3. The transceiver of claim 2, wherein the third area is substantially equal in size to the fourth area.

4. The transceiver of claim 3, wherein the first area and the second area are substantially equal in size to the third area and the fourth area.

5. The transceiver of claim 1, further comprising:

a controller for sending a current through the first antenna and the second antenna.

6. The transceiver of claim 5, wherein the controller sends a current through the first circuit in a first direction and a current through the second circuit in a second direction.

7. The transceiver of claim 6, wherein the controller alternates a direction of the current sent through one of the first and second circuits.

8. The transceiver of claim 5, wherein the merchandise marker comprises any one of an EAS marker and an RFID marker.

9. The transceiver of claim 8, wherein the first antenna and the second antenna are directional antennas.

10. The transceiver of claim 1, further comprising a detector, the detector detecting the merchandise marker by receiving a signal from one of the first antenna and the second antenna.

11. The transceiver of claim 10, further comprising:

an alarm, the alarm activating an indicator when the merchandise marker is detected by the detector.

12. A method for detecting a magneto-acoustic marker, comprising:

producing a first magnetic field by sending a current in a first direction through a first transceiver antenna, the first transceiver antenna having a first loop defining a first area and a second loop defining a second area substantially coplanar with the first area;

producing a second magnetic field by sending a current in a second direction through a second transceiver antenna having a third loop defining a third area and a fourth loop defining a fourth area substantially coplanar with the third area, the second transceiver antenna being substantially coplanar and orthogonally positioned with respect to the first transceiver antenna, the second antenna being configured to receive a driving signal for the current that is different from a driving signal for the current received by the first antenna; and detecting the magneto-acoustic marker by receiving a signal from the first or the second antenna.

13. The method of claim 12, further comprising:

alternating a direction of the current sent through one of the first and second antennas.

14. A system for detecting a magneto-acoustic merchandise marker, comprising:

a first antenna comprising a first circuit substantially having a figure-eight shape;

a second antenna comprising a second circuit substantially having a figure-eight shape, wherein the first antenna is substantially coplanar and orthogonally positioned with respect to the second antenna, the second antenna being configured to receive a driving signal that is different from a driving signal received by the first antenna;

a controller for sending a current through the first antenna and the second antenna; and a detector for detecting the magneto-acoustic merchandise marker via the first or second antenna.

15. The system of claim 14, wherein the first and the second antenna are transceiver antennas.

16. The system of claim 15, wherein the first and the second antenna are directional antennas.

17. The system of claim 14, wherein the merchandise marker comprises one of an EAS marker and an RFID marker.

18. The system of claim 14, wherein the controller alternates a direction of the current sent through one of the first circuit and the second circuit.

19. The system of claim 18, further comprising an alarm for activating an indicator when a merchandise marker is detected by the detector.

20. The system of claim 19, wherein the first antenna and the second antenna are affixed to a door.

* * * * *